United States Patent [19]

Schwaikert

[11] 4,401,225

[45] Aug. 30, 1983

[54] CHILD-RESISTANT CLOSURE UNIT

[75] Inventor: Ralph A. Schwaikert, Lakeville, Conn.

[73] Assignee: Rasco Incorporated, Lakeville, Conn.

[21] Appl. No.: 381,139

[22] Filed: May 24, 1982

[51] Int. Cl.[3] ..... B65D 55/02

[52] U.S. Cl. ..... 215/211; 220/281; 220/307; 220/DIG. 19

[58] Field of Search ..... 215/211, 224, 307, 301; 220/281, 307, DIG. 19

[56] References Cited

U.S. PATENT DOCUMENTS 3,669,295 6/1972 Horvath .
3,684,116 8/1972 Duffy .
3,704,802 12/1972 Schultz .
4,043,474 8/1977 McCord ..... 215/211
4,315,578 2/1982 Ludwig, Jr. ..... 220/366
4,371,095 2/1981 Montgomery ..... 215/211

*Primary Examiner*—George T. Hall
*Attorney, Agent, or Firm*—Panitch, Schwarze, Jacobs & Nadel

[57] ABSTRACT

A child-resistant closure unit is provided. The unit includes a container having a generally central opening and a resiliently flexible cover for the opening. The cover has a bottom flange on its periphery which engages the bottom of a curved surface on the periphery of the opening. Simultaneous depression of the cover and the pulling of a tab connected to the top rim of the cover disengages the cover. No specific orientation is required to either engage or disengage the cover.

8 Claims, 5 Drawing Figures

FIG. 1
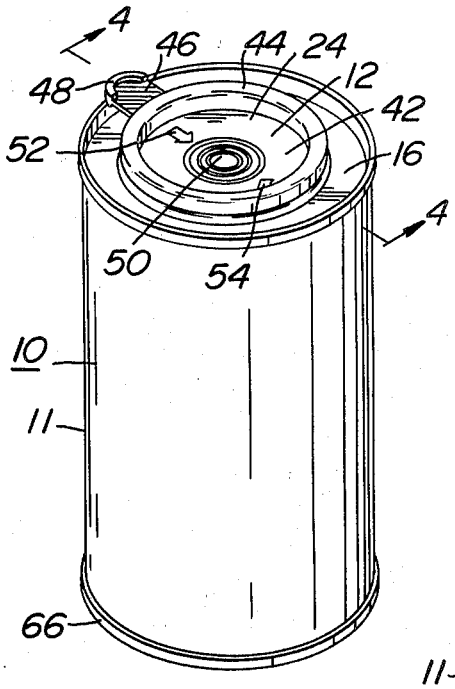
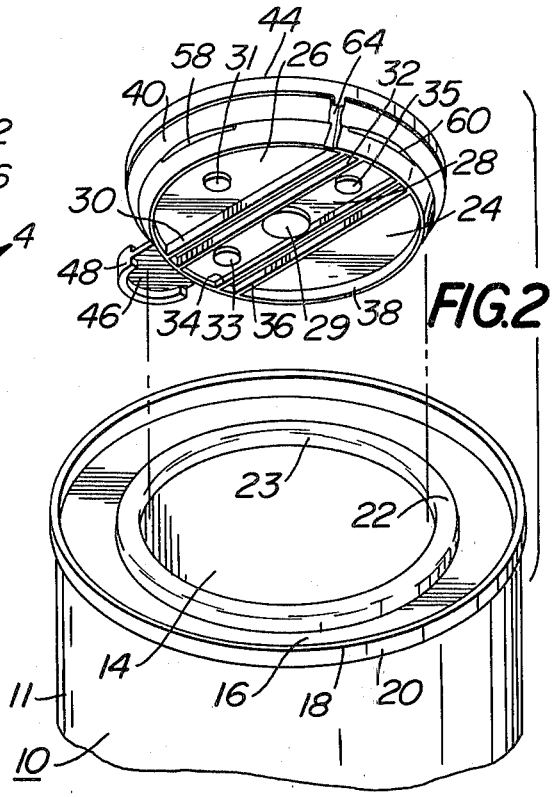
FIG.2
FIG.3
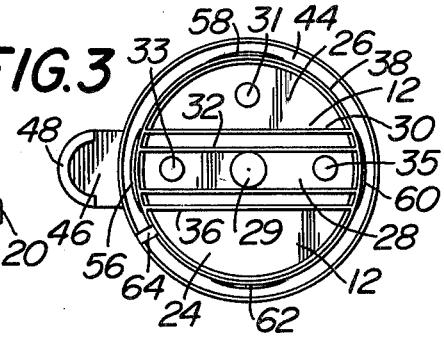
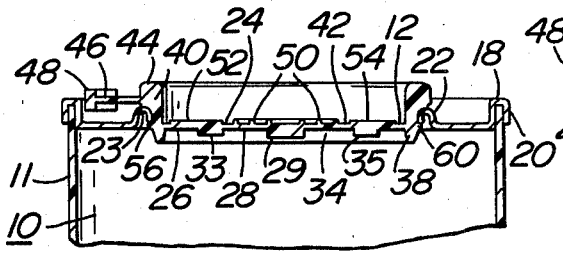
FIG. 4
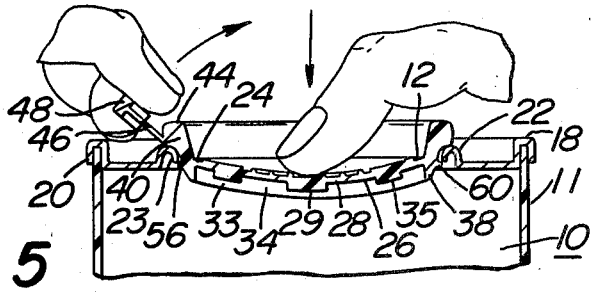
FIG. 5

CHILD-RESISTANT CLOSURE UNIT

BACKGROUND OF THE INVENTION

The present invention relates to a child-resistant closure unit for containment of poisonous, or potentially poisonous materials. More particularly, the present invention concerns a relatively inexpensive cylindrical container having a resiliently flexible closure that requires the dexterity of an adult to disengage.

The Poison Prevention Packaging Act has been adopted to reduce the incidence of accidental poisoning by children under the age of five caused by the opening of packages and containers holding pills, household cleaning substances and the like and ingestion of their contents. The present invention is directed to providing a safe and effective container-closure unit which conforms with the requirements of this Act.

Inexpensive containers presently on the market are generally cylindrical in shape and are made from metal, plastic, or cardboard. The container has a flat or planar bottom, which may be formed from plastic or metal, and a flat top also generally formed from plastic or metal. To dispense the contents of such containers, a removable, flexible plastic plug-type closure is provided for a central opening in the top of the container. Because such a package is relatively inexpensive, it is popular for use with low profit, poisonous household chemical compositions including, for instance, drain cleaners and toilet bowl cleaners. Such substances, while a household necessity, to be effective are necessarily extremely caustic and extremely dangerous if ingested. To provide a new package which is totally inaccessable to children could well destroy the profitability of such a commodity.

A problem which exists in the prior art is how to make such a simple, widely used container childproof along the guidelines suggested by the government for childproof closures. The guidelines require, in general, that the package be difficult, or nearly impossible for children to open, but relatively simple for adults to open.

U.S. Pat. No. 4,043,474 concerns a child-resistant closure for a container. U.S. Pat. No. 4,043,474 discloses the use of two lugs 42, 44 (180° apart) which must mate (align) with recesses 22, 24 in order to lock the closure in place. Accordingly, such closure requires a specific orientation.

U.S. Pat. No. 3,704,802 relates to a cap closure which requires both pressing and turning of the closure when both opening and closing the closure over the container. Locking projections on the container ride up camming protrusions on the closure until the projections snap into locking slots on the closure.

U.S. Pat. No. 3,684,116 concerns a child-resistant closure and container in which the safety closure cap fits within the interior of the container. A finger piece 32 must be used to manipulate the closure.

U.S. Pat. No. 3,669,295 concerns a safety cap for containers. This cap requires alignment of lugs and notches.

It is apparent from the above that there is a need for a childsafe container-closure unit which accomplishes the objects of inhibiting access to the contents therein by a child, while at the same time facilitating access by an adult, but in an inexpensive manner which does not rely on specific orientation of the closure.

SUMMARY OF THE INVENTION

The present invention is directed to a child-resistant closure unit which includes a container. The container is closed at one end thereof and has a generally circular opening at the other end thereof. The periphery of the container opening has a raised downwardly curved surface.

A resiliently flexible, generally circular, releasable cover is provided for snap-fit engagement with the container opening. The cover has a generally circular planar member. The planar member has bottom and top surfaces. On the bottom surface of the planar member is reinforcement means which extend through the center of the planar member in opposite directions towards its periphery.

The cover has a first raised rim located adjacent the periphery of the bottom surface of the planar member. The first raised rim has a diameter greater than that of the planar member. The first raised rim is elevated a distance beyond the bottom surface of the planar member so as to engage the bottom of the curved surface of the periphery of the opening when the cover is engaged over the opening.

Adjacent the periphery of the top surface of the planar member is a second raised rim. The second raised rim is disposed at a distance above the planar member so as to rest upon the curved surface of the periphery of the container opening when the cover is engaged over the opening. The second raised rim has a diameter greater than that of the planar member. A flange connects the first and second raised rims.

Extending outwardly from the second raised rim is a tab. The tab is generally in alignment with the reinforcing means.

The cover is pressed in said opening at any rotatable position to close the opening. The cover is disengaged by application of sufficient downward force at approximately the center of the planar member while the tab is simultaneously pulled in a generally upward direction.

Advantages of the present invention are set forth hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view of a child-resistant closure unit in accordance with the present invention.

FIG. 2 is an exploded partial perspective view of a child-resistant closure similar to FIG. 1 but showing the closure disengaged from the container.

FIG. 3 is a bottom plan view of the closure depicted in FIGS. 1 and 2.

FIG. 4 is a sectional view taken along the line 4—4 in FIG. 1.

FIG. 5 is a view similar to that depicted in FIG. 4, but showing how the closure is disengaged from the container by use of one's fingers.

DETAILED DESCRIPTION OF THE INVENTION

Referring to the drawings in detail, wherein like numerals indicate like elements, there is shown in FIG. 1 a container 10 which has a cylindrical side wall 11 and closed at its bottom end by way of a bottom integral wall, not shown. The container 10 may be of any other convenient shape other than cylindrical, such as for example rectangular. Container 10 can be fabricated from any suitable material such as, for example, plastic or metal. Container 10 is provided with a removable cover 12 which serves to close an opening 14 in the top end wall 16 of the container 10. The periphery of opening 14 is provided with a raised downwardly curved surface 22.

The periphery of the top end wall 16 of the container 10 is provided with a radially outwardly directed raised flange 18. Flange 18 has a curved top surface and has a lip 20 which overlaps the top of the side wall 11 of container 10 (see FIGS. 4 and 5).

Adjacent the bottom end wall of container 10 is an outwardly extending chime 66. Flange 18 and chime 66 project approximately equal radial distances beyond the side wall 11 of container 10 to permit container 10 to be spaced a slight distance apart from an identical container 10 when such containers 10 are placed side-by-side. This chime feature and other features are described in greater detail in my co-pending patent application Ser. No. 381,138 filed on even date herewith entitled "Stackable Container".

The cover 12 is resiliently flexible and generally circular. The cover 12 can be fabricated from any convenient material such as plastic. The cover 12 is designed so as to snap-fit engage with opening 14.

The cover 12 has a generally circular planar member 24. The bottom surface 26 of the planar member 24 has a reinforced section 28 extending through its center in opposite directions to its periphery. The reinforced section 28 is thicker than the planar member 24. A reinforcing button 29 is located on the bottom surface 26 of planar member 24. The reinforcing button 29 is disposed approximately in the center of the cover 12 and projects outwardly from the reinforced section 28. Knock-out buttons 31, 33, 35 are disposed on the bottom surface 26 of planar member 24. These knock-out buttons 31, 33, 35 facilitate in the molding of the cover 12.

Generally straight and parallel ribs 30, 32, 34, 36 surround the reinforced section 28. There are two ribs on each side of the reinforced section 28 to add further support to the planar member 24. See FIG. 3.

Adjacent the periphery of the bottom surface 26 of the planar member 24 is a first raised rim 38. First raised rim 38 extends a distance beyond the bottom surface 26 of the planar member 24 so as to engage the bottom edge 23 of the curved surface 22. The diameter of the first raised rim 38 is greater than that of the planar member 24, but less than that of the second raised rim 44 which is adjacent the periphery of the top surface 42 of planar member 24. The second raised rim 44 is raised a distance above the top surface 42 of the planar member 24 so as to rest on the raised downwardly curved surface 22 when the cover 12 engages the opening 14. A connector flange 40 connects the first and second raised rims 38 and 44.

A tab 46 extends radially outwardly from the second raised rim 44. Tab 46 is generally aligned with the reinforced section 28. The outer periphery of tab 46 can be curved as shown in FIGS. 1-3 and have a raised section 48 to facilitate a user's forefinger (on top of the tab 46) and thumb (on the bottom of tab 46).

In a preferred embodiment of the present invention, lugs 56, 58, 60, 62 can be disposed approximately equidistantly on the outer edge of the first raised rim 38. Lugs 56, 58, 60 and 62 extend outwardly a short distance so as to engage the bottom edge 23 of the raised downwardly curved surface 22. Two of the lugs 56, 58, 60, 62, namely lugs 56, 60 are generally aligned with tab 46. The purpose of lugs 56, 58, 60, 62 is to hinder the cover 12 from being removed with one's fingers and/or teeth from any position without exercising the child-resistant mode as described hereinbelow. The lugs 56, 58, 60, 62 do not, however, require any particular orientation in relation to the opening 14.

The cover 12 is engaged in opening 14 by pressing down on the cover 12 until it is snapped in place (a snapping noise is heard). FIG. 5 illustrates the disengagement of the cover 12 from the container 10. To disengage the cover 12, one presses down (preferably with one's thumb) in the center of the top surface 26 of the cover 12 adjacent the "bullseye" 50 disposed between arrows 52, 54. Simultaneously, one pulls in an upward direction on tab 46 with the forefinger and thumb of the other hand. Removal of the cover 12 thus requires two-handed operation. One hand is required to depress cover 12, while the other hand is required to pull upward on the tab 46.

There is no need to specifically orientate the cover 12 for either its engagement or disengagement. The downward pressure on cover 12 serves to distort the cover 12 sufficiently enough to pull the forward lug 56 far enough away from the bottom edge 23 of the raised downwardly curved surface 22, thereby releasing the cover 12. Without depressing the center of the cover 12, a relatively large force would be required to remove it.

A vent 64 can be provided on the periphery of cover 12. One or more vents such as vent 64 can be utilized to release any built-up gas pressure within container 10. The vent 64 is a relatively thin vertical cut-out section running from the first raised rim 38 through connector flange 40 to the second raised rim 44.

A prehensile gripping of the tab 46 is required for removal, that is, the thumb and index finger are applied. It is the prehensile grip which is least well developed in children of the "dangerous" age range of $2\frac{1}{2}$ to $4\frac{1}{2}$ years old. Therefore, the present invention offers a maximum degree of resistance to the weakest form of grip that the child of such age range can apply.

The present invention has distinct advantages over other safety closures. In almost all other safety closures when the safety feature is removed, the consumer forfeits or does not take time to reclose so as to reactivate the safety feature. The closure of the present invention simply snaps into the container opening, and the safety feature is automatically operative.

The present invention is particularly applicable to hygroscopic products which will absorb moisture from the atmosphere if the container opening is not resealed. On absorbing moisture, the contents will cake or in some cases deteriorate. The consumer using such packages is usually knowledgeable of the consequences and will replace the closure to save the product. In the present invention, simply by replacing the closure with a minimum effort, returns the container to the child-resistant position.

Other advantages of the safety closure are that it has a simple and easy to understand principle regarding removal. Moreover, the closure is inexpensive when compared to other safety closures presently available on the market.

The present invention also provides significant advantages over closures such as that described in U.S.

Pat. No. 4,043,474. The cover 12 of the present invention is automatically operative without exception when the cover 12 is inserted in the opening 14 of the container 10. No orientation of the cover 12 is required.

The present invention may be embodied in other specific forms without departing from the spirit or essential attributes thereof and, accordingly, reference should be made to the appended claims, rather than to the foregoing specification, as indicating the scope of the invention.

I claim:

1. A child-resistant closure unit which comprises:

(1) a container, said container closed at one end thereof and having a generally circular opening at the other end thereof, the periphery of said opening having a raised downwardly curved surface, and (2) a resiliently flexible, generally circular, releasable cover for snap-fit engagement with said opening, said cover comprising:

(a) a generally circular planar member, said planar member having a bottom surface and a top surface, said bottom surface having reinforcement means extending through approximately its center in opposite directions towards the periphery thereof, (b) a first raised rim adjacent the periphery of said planar member on its bottom surface, said first raised rim having a diameter greater than that of said planar member, said first raised rim elevated a distance beyond the bottom surface of said planar member so as to engage the bottom of said curved surface when said cover is engaged in said opening;

(c) a second raised rim adjacent the periphery of said top surface of the planar member, said second raised rim elevated a distance beyond said planar member so as to rest upon said curved surface when said cover is engaged in said opening, and said second raised rim having a diameter greater than that of said planar member and greater than that of said first raised rim;

(d) a flange connecting said first and second raised rims, and (e) a tab extending outwardly from said first raised rim, said tab generally in alignment with said reinforcing means, said cover being capable of being pressed in said opening at any rotatable position to close the opening and disengaged by application of sufficient downward force at approximately the center of the planar member, while said tab is simultaneously pulled in a generally upward direction.

2. A child-resistant closure unit in accordance with claim 1 wherein there are four lugs approximately equidistantly disposed on said second rim, such that two lugs are generally aligned with said reinforcement means.

3. A child-resistant closure unit in accordance with claim 1 wherein said reinforcement means comprises an area thicker than said planar member.

4. A child-resistant closure unit in accordance with claim 3 wherein said reinforcement means further comprises a plurality of generally straight ribs adjacent said thickened area.

5. A child-resistant closure unit in accordance with claim 3 wherein a reinforcing button projects outwardly from said thickened area.

6. A child-resistant closure unit in accordance with claim 1 wherein a plurality of concentric circles are disposed at approximately the center of the top surface of the planar member so as to indicate the point where downward pressure is to be applied to said planar member.

7. A child-resistant closure unit in accordance with claim 1 wherein said tab has a curved outer end and a raised periphery on both its top and bottom surfaces to accommodate a user's fingers.

8. A child-resistant closure unit in accordance with claim 1 wherein at least one vent is provided by a relatively thin vertical cut-out section running through said second rim and said flange up to said first rim so as to be able to vent pressure build-up within said container.

* * * * *

UNITED STATES PATENT AND TRADEMARK OFFICE

CERTIFICATE OF CORRECTION

PATENT NO. : 4,401,225

DATED : August 30, 1983

INVENTOR(S) : Ralph A. Schwaikert

It is certified that error appears in the above-identified patent and that said Letters Patent is hereby corrected as shown below:

Claim 1,
Col 6, line 3, delete "first" and substitute --second--;

Claim 2,
Col 6, line 14, delete "second" and substitute --first--;

Claim 8,
Col 6, line 40, delete "second" and substitute --first--;

Col 6, line 40, delete "first" and substitute --second--.

Signed and Sealed this

*Twenty-first* Day of *February 1984*

[SEAL]

*Attest:*

GERALD J. MOSSINGHOFF

*Attesting Officer*

*Commissioner of Patents and Trademarks*